US005836087A

United States Patent [19]

Wilson et al.

[11] Patent Number: 5,836,087

[45] Date of Patent: Nov. 17, 1998

[54] FOOTWEAR DRYER SUPPORT ROD

[76] Inventors: James E. Wilson; Barbara M. Wilson, both of 2083 S. Melanie Dr., Homosassa, Fla. 34448

[21] Appl. No.: 877,156

[22] Filed: Jun. 17, 1997

[51] Int. Cl.[6] ..... F26B 13/10

[52] U.S. Cl. ..... 34/528; 34/89; 34/104; 34/202

[58] Field of Search ..... 34/104, 202, 89, 34/528

[56] References Cited

U.S. PATENT DOCUMENTS

| | | | |
|---|---|---|---|
| 3,316,659 | 5/1967 | Lauck | 34/133 |
| 3,643,346 | 2/1972 | Lester | 34/202 |
| 3,793,744 | 2/1974 | Saita | 34/202 |
| 4,091,548 | 5/1978 | Daily | 34/133 |
| 4,109,397 | 8/1978 | Daily | 34/239 |
| 4,617,743 | 10/1986 | Barnard | 34/109 |
| 5,276,979 | 1/1994 | Gordon, Sr. | 34/133 |
| 5,333,393 | 8/1994 | Hill et al. | 34/440 |
| 5,365,675 | 11/1994 | Shabram, Jr. | 34/109 |
| 5,398,428 | 3/1995 | Wallace | 34/600 |
| 5,412,928 | 5/1995 | Reithel | 34/104 |
| 5,469,635 | 11/1995 | Lamontagne et al. | 34/104 |

*Primary Examiner*—Ronald C. Capossela
*Attorney, Agent, or Firm*—Joseph N. Breaux

[57] ABSTRACT

A footwear dryer support rod that includes an interconnectable rod assembly including a fixed length rod section, a circuit housing rod section, and a spring loaded telescoping rod section; an alarm circuit housed within the circuit housing rod section including a detecting circuit and an alarm circuit, the alarm circuit including an electrically driven audible output device; two disk shaped, resilient protector pads, one resilient protector pad being securable to the end of the fixed length rod section and one resilient protector pad being securable to the end of the spring loaded telescoping rod section; a first moisture probe pair extending outwardly from the end of the fixed length rod section and positioned through one of the resilient protector pads; and a second moisture probe pair extending outwardly from the end of the telescoping rod section and positioned through a one of the resilient protector pads.

20 Claims, 3 Drawing Sheets

FOOTWEAR DRYER SUPPORT ROD

TECHNICAL FIELD

The present invention relates to support devices and more particularly to a footwear dryer support rod for supporting a pair of athletic shoes or the like in the drying drum of a conventional clothes dryer wherein the footwear dryer support rod includes an interconnectable rod assembly including a fixed length rod section, a circuit housing rod section, and a spring loaded telescoping rod section; an alarm circuit housed within the circuit housing rod section including a detecting circuit and an alarm circuit, the alarm circuit including an electrically driven audible output device; two disk shaped, resilient protector pads, one resilient protector pad being securable to the end of the fixed length rod section and one resilient protector pad being securable to the end of the spring loaded telescoping rod section; a first moisture probe pair extending outwardly from the end of the fixed length rod section and positioned through one of the resilient protector pads; and a second moisture probe pair extending outwardly from the end of the telescoping rod section and positioned through a one of the resilient protector pads.

BACKGROUND OF THE INVENTION

Because athletic shoes are worn during periods of high athletic activity and are constructed from moisture absorbing materials they can rapidly become soiled and foul smelling. Although most athletic shoes can be washed in a conventional washing machine, the weight of the athletic shoes can cause damage to a conventional clothes dryer when the athletic shoes are tumble dried in the drying drum of a conventional dryer. It would be a benefit, therefore, to have a support rod for supporting the athletic shoes against the drum wall of a conventional dryer drum of a clothes dryer to prevent the athletic shoes from tumbling against the drum wall during the drying cycle. Because most athletic shoes include a large proportion of heat sensitive plastic materials, it would also be a benefit to have a moisture detecting mechanism for detecting the moisture level within the athletic shoes and an alarm mechanism for producing an audible alarm when the moisture detecting mechanism detects a low moisture level in the athletic shoes to alert the user to turn off the clothes dryer. It would of course be a further benefit to have a moisture detecting mechanism that included moisture detecting probes that detected the moisture level of each of the athletic shoes and that only triggered the audible alarm when both athletic shoes had achieved a combined predetermined low moisture level.

SUMMARY OF THE INVENTION

It is thus an object of the invention to provide a footwear dryer support rod for supporting athletic shoes against the drum wall of a dryer drum of a clothes dryer.

It is a further object of the invention to provide a footwear dryer support rod that includes a moisture detecting mechanism for detecting the moisture level within the athletic shoes.

It is a still further object of the invention to provide a footwear dryer support rod that includes an audible alarm.

It is a further object of the invention to provide a footwear dryer support rod that includes a moisture detecting mechanism for detecting the moisture level within the athletic shoes and triggering an audible alarm when the moisture level is detected.

It is a still further object of the invention to provide a footwear dryer support rod that includes a moisture detecting mechanism that includes moisture detecting probes that detect the moisture level of each of the athletic shoes and that only triggers the audible alarm when both athletic shoes had achieved a combined predetermined low moisture level.

It is a still further object of the invention to provide a footwear dryer support rod that includes an interconnectable rod assembly including a fixed length rod section, a circuit housing rod section, and a spring loaded telescoping rod section; an alarm circuit housed within the circuit housing rod section including a detecting circuit and an alarm circuit, the alarm circuit including an electrically driven audible output device; two disk shaped, resilient protector pads, one resilient protector pad being securable to the end of the fixed length rod section and one resilient protector pad being securable to the end of the spring loaded telescoping rod section; a first moisture probe pair extending outwardly from the end of the fixed length rod section and positioned through one of the resilient protector pads; and a second moisture probe pair extending outwardly from the end of the telescoping rod section and positioned through a one of the resilient protector pads.

It is a still further object of the invention to provide a footwear dryer support rod that accomplishes some or all of the above objects in combination.

Accordingly, a footwear dryer support rod is provided. The footwear dryer support rod includes an interconnectable rod assembly including a fixed length rod section, a circuit housing rod section, and a spring loaded telescoping rod section; an alarm circuit housed within the circuit housing rod section including a detecting circuit and an alarm circuit, the alarm circuit including an electrically driven audible output device; two disk shaped, resilient protector pads, one resilient protector pad being securable to the end of the fixed length rod section and one resilient protector pad being securable to the end of the spring loaded telescoping rod section; a first moisture probe pair extending outwardly from the end of the fixed length rod section and positioned through one of the resilient protector pads; and a second moisture probe pair extending outwardly from the end of the telescoping rod section and positioned through a one of the resilient protector pads.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
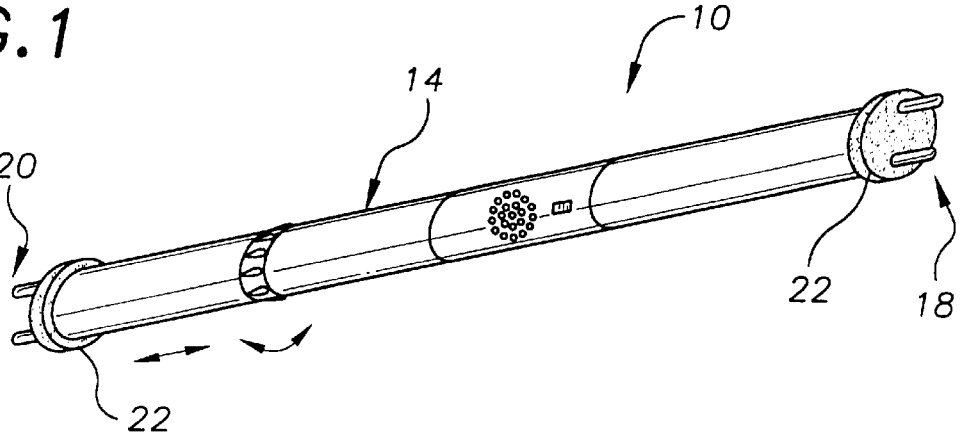
FIG. 1 is a perspective view of an exemplary embodiment of the footwear dryer support rod of the present invention showing the rod assembly including the fixed length rod section, the circuit housing rod section, and the spring loaded telescoping rod section; the two disk shaped, resilient protector pads; the first moisture probe pair extending outwardly from the end of the fixed length rod section; and the second moisture probe pair extending outwardly from the end of the telescoping rod section.

FIG. 1 shows an exemplary embodiment of the footwear dryer support rod of the present invention, generally designated by the numeral 10. In this embodiment, footwear dryer support rod 10 includes an interconnectable rod assembly, generally designated 14; an alarm circuit, generally designated 16 (shown schematically in FIG. 5); a first moisture probe pair, generally designated 18; a second moisture probe pair, generally designated 20; and two identical disk shaped, resilient protector pads 22.

Figure 2:
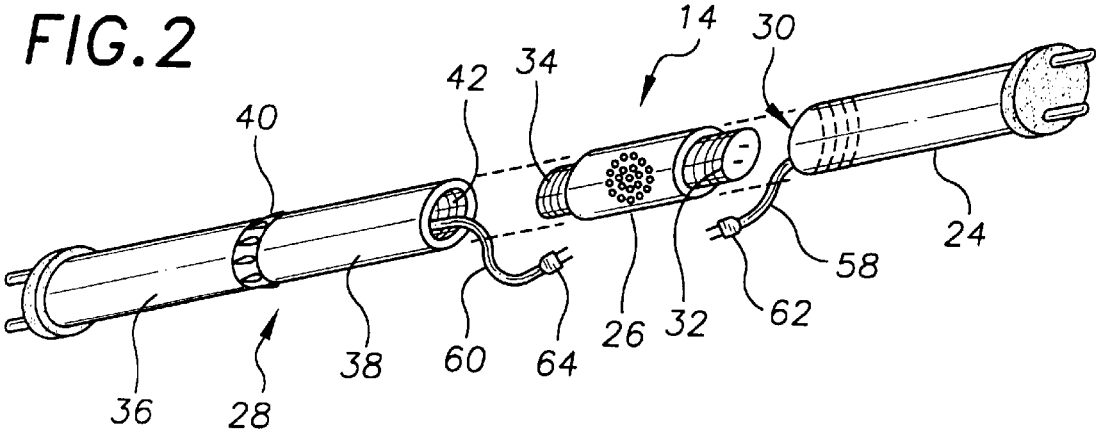
FIG. 2 is a perspective view showing the rod assembly disassembled with the first moisture probe connecting plug extending outwardly from the connecting end of the fixed length rod section and the second moisture probe connecting plug extending outwardly from the connecting end of the spring loaded telescoping rod section.

With reference to FIG. 2, interconnectable rod assembly 14 includes a fixed length rod section 24, a circuit housing rod section 26, and a spring loaded telescoping rod section, generally designated 28. Fixed length rod section 24 is a length of high temperature ABS plastic tubing having a first internally threaded connecting end 30. Circuit housing rod section 26 is a length of high temperature ABS plastic tubing having a first externally threaded circuit housing connecting end 32 and a second externally threaded circuit housing connecting end 34. First externally threaded circuit housing connecting end 32 and first internally threaded connecting end 30 are threadably connectable.

Figure 4:
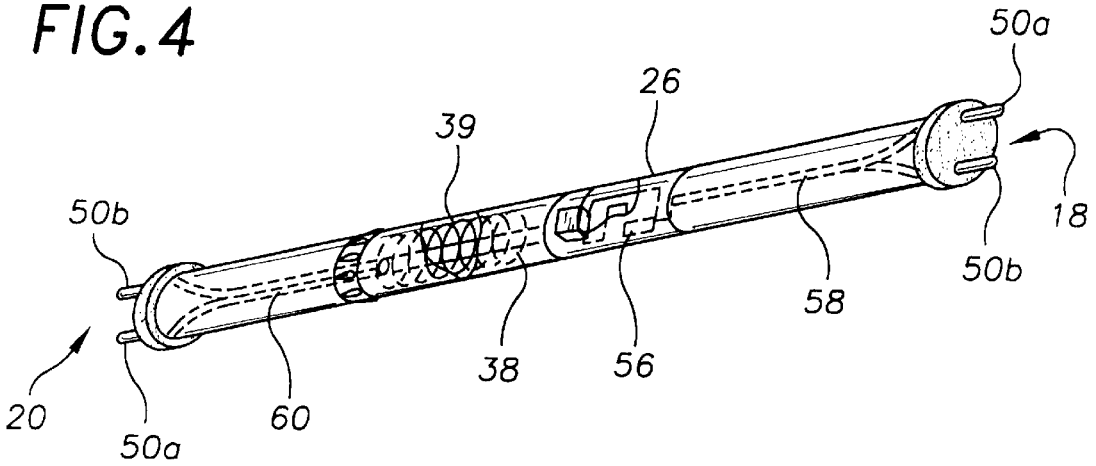
FIG. 4 is a perspective, partial cut-away view of the exemplary footwear dryer support rod of FIG. 1 showing the biasing spring within the telescoping rod section, the alarm circuitry housed within the circuit housing rod section, and the wiring connecting the first and second moisture probe pairs and the alarm circuit board.

Spring loaded telescoping rod section 28 includes a probe section 36 and a connecting section 38. Probe section 36 and connecting section 38 are each lengths of high temperature ABS plastic tubing. Probe section 36 is slidable into connecting section 38 and, with reference to FIG. 4, is biased out of connecting section 38 by a steel, compression, biasing spring 39 housed within connecting section 38. With reference once again to FIG. 2, a collet nut 40 is provided on connecting section 38 to grip and hold probe section 36 in a desired user set position. Connecting section 38 includes a second internally threaded connecting end 42 that is threadably connectable to second externally threaded end 34 of circuit housing section 26.

Figure 3:
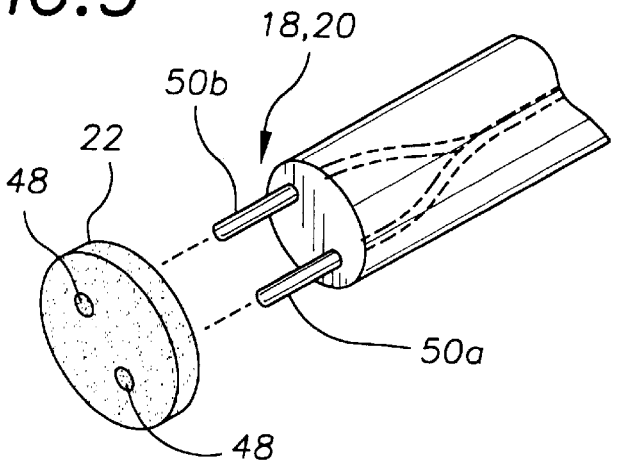
FIG. 3 is a perspective detail view of one of the two identical disk shaped, resilient plastic protector pads exploded away from the end of the telescoping rod section showing the moisture probe pair insertion apertures formed through the protector pad.

Referring now to FIG. 3, each disk shaped, resilient plastic protector pad 22 is a one-half inch thick, circular disk shaped section of resilient, high temperature, foam plastic that has two spaced probe pair insertion apertures 48 formed therethrough and through which probe prongs 50*a*,50*b* of first and second moisture probe pairs 18,20 are inserted during assembly.

Referring now to FIG. 4, in this embodiment probe prongs 50*a*,50*b* are constructed of copper and have a tapered tip end. Each probe pair 18,20 is connected to an alarm circuit board 56 by a connecting cable 58,60 respectively. Referring back to FIG. 2, connecting cable 58 has a has a first moisture probe connecting plug 62 connected at the free end thereof that extends out from first connecting end 30 of fixed length rod section 24 and that is connectable with a connecting jack 61 (FIG. 5) provided on circuit board 56 (FIG. 4). Connecting cable 60 has a second moisture probe connecting plug 64 connected at the free end thereof that extends out from second connecting end 42 of connecting section 38 and that is connectable with a connecting jack 63 (FIG. 5) provided on circuit board 56 (FIG. 4).

Figure 5:
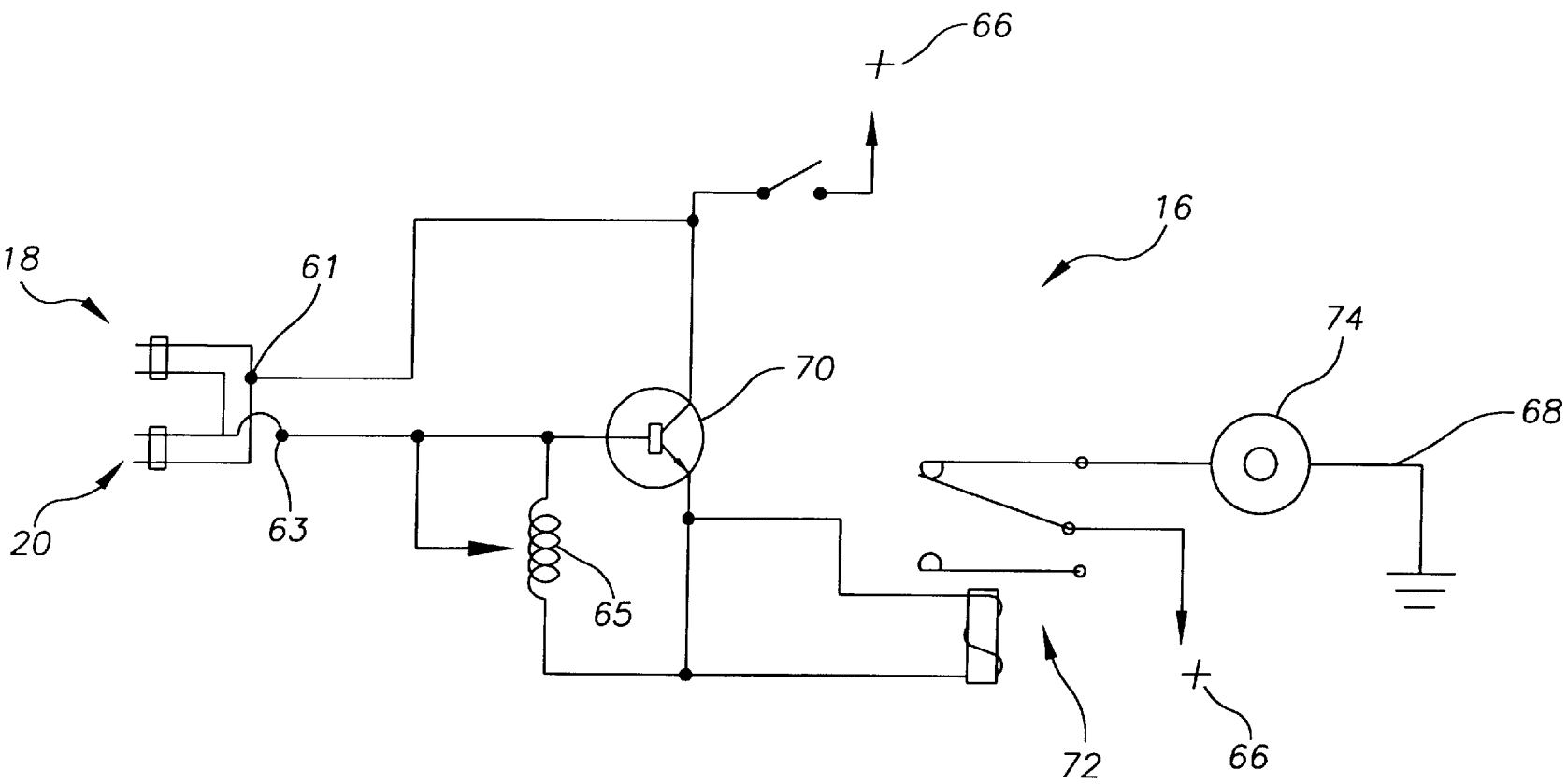
FIG. 5 is a schematic diagram of the alarm circuit showing the battery connections, the switching transistor, the first and second moisture probe pairs, the normally closed alarm relay, and the alarm buzzer.

With reference to FIG. 5, alarm circuit 16 includes a detecting circuit including a switching transistor 70, first and second moisture probe pairs 18,20, a biasing resistor 65 and a normally closed alarm relay 72; an alarm device circuit including a piezo electric alarm buzzer 74; and a nine-volt battery connector including a positive terminal 66 and a negative terminal 68. In this embodiment, the detecting circuit of alarm circuit 16 detects the current flow between the two probe prongs 50*a*,50*b* of each probe pair 18,20 as the indicator of the moisture remaining in the athletic shoes. The moire moisture in the athletic shoes the greater the conducting current. When no moisture is present in either shoe no current flows between probe prongs 50*a*,50*b* of each probe pair 18,20 and piezo electric buzzer 74 is activated.

Figure 6:
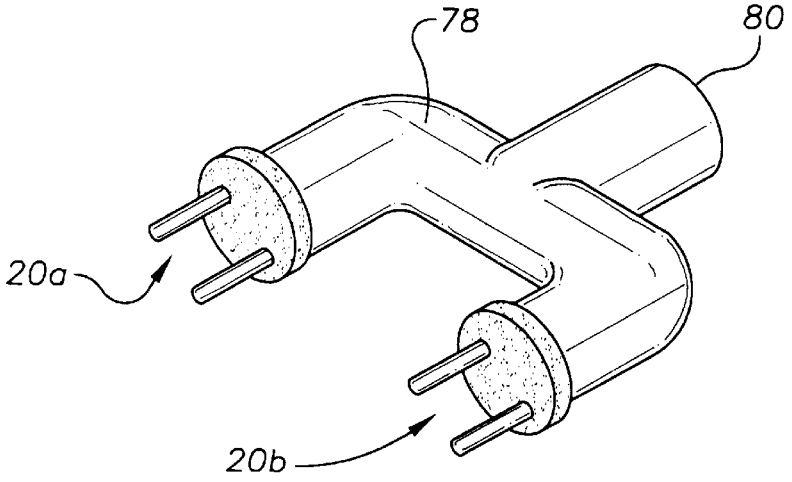
FIG. 6 is a perspective view of a dual moisture probe pair adapter.

With reference to FIG. 6, when a large athletic shoe is to be dried, it can be desirable to use a dual moisture probe pair adapter 78 that includes two moisture probe pairs 20*a*,20*b* and a jack end 80 that fits over either moisture probe pairs 18,20 (FIG. 1). In addition, two identical dual moisture probe pair adapters 78 can be used to allow a user to dry two pairs of shoes at the same time.

It can be seen from the preceding description that a footwear dryer support rod has been provided that includes a moisture detecting mechanism for detecting the moisture level within the athletic shoes; that includes an audible alarm; that includes a moisture detecting mechanism for detecting the moisture level within the athletic shoes and triggering an audible alarm when the moisture level is detected; that includes a moisture detecting mechanism that includes moisture detecting probes that detect the moisture level of each of the athletic shoes and that only triggers the audible alarm when both athletic shoes had achieved a combined predetermined low moisture level; and that includes an interconnectable rod assembly including a fixed length rod section, a circuit housing rod section, and a spring loaded telescoping rod section; an alarm circuit housed within the circuit housing rod section including a detecting circuit and an alarm circuit, the alarm circuit including an electrically driven audible output device; two disk shaped, resilient protector pads, one resilient protector pad being securable to the end of the fixed length rod section and one resilient protector pad being securable to the end of the spring loaded telescoping rod section; a first moisture probe pair extending outwardly from the end of the fixed length rod section and positioned through one of the resilient protector pads; and a second moisture probe pair extending outwardly from the end of the telescoping rod section and positioned through a one of the resilient protector pads.

It is noted that the embodiment of the footwear dryer support rod described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A footwear dryer support rod comprising:

an interconnectable rod assembly including a fixed length rod section, a circuit housing rod section, and a telescoping rod section;

an alarm circuit housed within said circuit housing rod section including a detecting circuit and an alarm device circuit, said alarm device circuit including an electrically driven audible output device;

a first moisture probe pair extending outwardly from a first end of said fixed length rod section; and a second moisture probe pair extending outwardly from a second end of said telescoping rod section.

2. The footwear dryer support rod of claim 1, wherein:

said telescoping rod section is spring loaded.

3. The footwear dryer support rod of claim 2, further including:

two disk shaped, resilient protector pads, one of said two resilient protector pads being securable to said end of said fixed length rod section, one of said two resilient protector pad being securable to said end of said telescoping rod section.

4. The footwear dryer support rod of claim 3 wherein:

said first moisture probe pair is positioned through one of said two resilient protector pads; and said second moisture probe pair is positioned through one of said two resilient protector pads.

5. The footwear dryer support rod of claim 4 wherein:

said detecting circuit includes a pair of first pair of connecting jacks and a second pair of connecting jacks;

said first moisture probe pair includes a first pair of connecting wires having a first dual prong plug secured to the end thereof that is mateable with the first pair of connecting jacks of said detecting circuit; and said second moisture probe pair includes a second pair of connecting wires having a second dual prong plug secured to the end thereof that is mateable with the second pair of connecting jacks of said detecting circuit.

6. The footwear dryer support rod of claim 2 wherein:

said detecting circuit includes a pair of first pair of connecting jacks and a second pair of connecting jacks;

said first moisture probe pair includes a first pair of connecting wires having a first dual prong plug secured to the end thereof that is mateable with the first pair of connecting jacks of said detecting circuit; and said second moisture probe pair includes a second pair of connecting wires having a second dual prong plug secured to the end thereof that is mateable with the second pair of connecting jacks of said detecting circuit.

7. The footwear dryer support rod of claim 3 wherein:

said detecting circuit includes a pair of first pair of connecting jacks and a second pair of connecting jacks;

said first moisture probe pair includes a first pair of connecting wires having a first dual prong plug secured to the end thereof that is mateable with the first pair of connecting jacks of said detecting circuit; and said second moisture probe pair includes a second pair of connecting wires having a second dual prong plug secured to the end thereof that is mateable with the second pair of connecting jacks of said detecting circuit.

8. The footwear dryer support rod of claim 2 wherein:

said electrically driven audible output device is a piezo crystal buzzer.

9. The footwear dryer support rod of claim 2 wherein:

said circuit housing rod section has a plurality of audible alarm output holes formed through the sidewall thereof.

10. The footwear dryer support rod of claim 1, further including:

two disk shaped, resilient protector pads, one of said two resilient protector pads being securable to said first end of said fixed length rod section, one of said two resilient protector pad being securable to said second end of said telescoping rod section.

11. The footwear dryer support rod of claim 10 wherein:

said first moisture probe pair is positioned through one of said two resilient protector pads; and said second moisture probe pair is positioned through one of said two resilient protector pads.

12. The footwear dryer support rod of claim 11 wherein:

said detecting circuit includes a pair of first pair of connecting jacks and a second pair of connecting jacks;

said first moisture probe pair includes a first pair of connecting wires having a first dual prong plug secured to the end thereof that is mateable with the first pair of connecting jacks of said detecting circuit; and said second moisture probe pair includes a second pair of connecting wires having a second dual prong plug secured to the end thereof that is mateable with the second pair of connecting jacks of said detecting circuit.

13. The footwear dryer support rod of claim 10 wherein:

said detecting circuit includes a pair of first pair of connecting jacks and a second pair of connecting jacks;

said first moisture probe pair includes a first pair of connecting wires having a first dual prong plug secured to the end thereof that is mateable with the first pair of connecting jacks of said detecting circuit; and said second moisture probe pair includes a second pair of connecting wires having a second dual prong plug secured to the end thereof that is mateable with the second pair of connecting jacks of said detecting circuit.

14. The footwear dryer support rod of claim 1 wherein:

said detecting circuit includes a pair of first pair of connecting jacks and a second pair of connecting jacks;

said first moisture probe pair includes a first pair of connecting wires having a first dual prong plug secured to the end thereof that is mateable with the first pair of connecting jacks of said detecting circuit; and said second moisture probe pair includes a second pair of connecting wires having a second dual prong plug secured to the end thereof that is mateable with the second pair of connecting jacks of said detecting circuit.

15. The footwear dryer support rod of claim 14 wherein:

said electrically driven audible output device is a piezo crystal buzzer.

16. The footwear dryer support rod of claim 14 wherein:

said circuit housing rod section has a plurality of audible alarm output holes formed through the sidewall thereof.

17. The footwear dryer support rod of claim 16 wherein:

said circuit housing rod section has a plurality of audible alarm output holes formed through the sidewall thereof.

18. The footwear dryer support rod of claim 1 wherein:

said electrically driven audible output device is a piezo crystal buzzer.

19. The footwear dryer support rod of claim 6 wherein:

said circuit housing rod section has a plurality of audible alarm output holes formed through the sidewall thereof.

20. The footwear dryer support rod of claim 1 wherein:

said circuit housing rod section has a plurality of audible alarm output holes formed through the sidewall thereof.

* * * * *